US006750735B1

(12) United States Patent
Bertin et al.

(10) Patent No.: US 6,750,735 B1
(45) Date of Patent: Jun. 15, 2004

(54) WAVEGUIDE POLARIZER

(75) Inventors: Giorgio Bertin, Turin (IT); Bruno Piovano, Turin (IT); Luciano Accatino, Turin (IT)

(73) Assignee: Telecom Italia Lab S.p.A., Turin (IT)

( * ) Notice: Subject to any disclaimer, the term of this patent is extended or adjusted under 35 U.S.C. 154(b) by 0 days.

(21) Appl. No.: 10/204,123

(22) PCT Filed: Feb. 13, 2001

(86) PCT No.: PCT/IT01/00063

§ 371 (c)(1),
(2), (4) Date: Aug. 14, 2002

(87) PCT Pub. No.: WO01/65628

PCT Pub. Date: Sep. 7, 2001

(30) Foreign Application Priority Data

Feb. 29, 2000 (IT) ..... TO2000A0192

(51) Int. Cl.[7] ..... H01P 1/17

(52) U.S. Cl. ..... 333/21 A; 333/21 R; 333/208; 333/212

(58) Field of Search ..... 333/21 A, 21 R, 333/208, 212, 248

(56) References Cited

U.S. PATENT DOCUMENTS 3,597,710 A * 8/1971 Levy ..... 333/210
4,030,051 A 6/1977 Shimizu et al.
4,672,334 A * 6/1987 Saad ..... 333/21 A
4,982,171 A * 1/1991 Figlia et al. ..... 333/157
5,703,547 A * 12/1997 Bertin et al. ..... 333/209
5,805,035 A * 9/1998 Accatino et al. ..... 333/208
5,877,123 A * 3/1999 Das ..... 505/210
5,886,594 A 3/1999 Guglielmi et al.
5,935,910 A * 8/1999 Das ..... 505/210
6,005,457 A * 12/1999 Wu ..... 333/208
6,232,853 B1 * 5/2001 Goulouev ..... 333/208

FOREIGN PATENT DOCUMENTS

EP 0 762 529 3/1997

* cited by examiner

*Primary Examiner*—Michael Toker
*Assistant Examiner*—Khai Nguyen
(74) *Attorney, Agent, or Firm*—Herbert Dubno

(57) ABSTRACT

The waveguide polarizer is a device for microwave antenna systems consisting of a waveguide section, with circular cross-section, being equipped with two terminal flanges for connection to other circular guides. A certain number of elliptical irises are arranged inside at regular intervals, resting on parallel planes and all oriented in the same way, i.e. with their longer axes all belonging to the same axial plane.

5 Claims, 1 Drawing Sheet

WAVEGUIDE POLARIZER

CROSS REFERENCE TO RELATED APPLICATIONS

This application is a national stage of PCT/IT01/00063 filed 13 Feb. 2001 and is based upon Italian national application TO 2000 A 000192 filed 29 Feb. 2000 under the International Convention.

TECHNICAL FIELD

This invention relates to devices for telecommunication systems employing microwaves and, in particular, it relates to a waveguide polarizer.

BACKGROUND ART

As known, a polarizer is a device for microwave antenna systems, made within a waveguide structure, capable of transforming the characteristics of an electromagnetic field that propagates inside the polarizer. Particularly, the polarizer can transform a linear polarized electromagnetic field into a circular polarized electromagnetic field and vice versa, being reciprocal in its operation.

As is known, there are two main groups of polarizers, according to the type of inserts arranged inside the waveguide to generate the necessary shifting of the orthogonal components of the electromagnetic field. As described in the book entitled "Waveguide Components for Antenna Feed Systems: Theory and CAD" written by J. Uher et al., 1993 Artech House, these inserts can be of the septum or iris type.

A septum polarizer may consist of a waveguide section, with square cross-section, inside which a metal stepped septum is arranged in parallel to the sides and in an intermediate position. Operation is based on the transformation of the square cross-section guide into two rectangular cross-section guides, in which the polarized fields are propagated orthogonally.

An iris polarizer may consist of a waveguide section, is with circular cross-section, inside which the irises, consisting of two equal and counterpoised circular segments, are arranged in the form of a cascade. The irises may have different dimensions, but are generally arranged at regular intervals. Their purpose is to vary the transverse dimensions of the guide so as to generate different phase shifts between the orthogonal components of the electromagnetic field. The global shifting is achieved by summing the partial shifting introduced by each iris. A similar polarizer can also be made by implementing a square waveguide by using rectangular shape irises.

To construct an iris polarizer, the waveguide is made of two longitudinal halves, equipped with suitable flanges, to allow the two halves to be screwed together. Inside each half, the irises are made by means of a suitable form of mechanical machining, generally by means of milling and electro-etching.

During assembly, special care is required to exert the right tightening pressure on the screws, to avoid undesired deformation of the guide, with consequent errors in the amount of shift introduced.

In order to prevent such a problem, the guide should be, a single piece, but this would cause greater problems for the mechanical machining of irises. This is because the irises would need to be made using specifically constructed electro-etching tools which would have to be used in conditions with no visibility and which will produce the sharp edges between each iris and the inner side of the guide.

Another requirement is to make the polarizer according to an accurate to design, which will result in operation that is compliant with the required specifications, thus avoiding the need to conduct adjustments and calibrations after the device has been completed.

The design may be accurate if the mechanical characteristics of the polarizer, and consequently, of the guide with the respective irises, can be expressed by means of a very accurate and efficient electromagnetic model. The automated procedures which are currently available allow this, providing that the transverse sections of the polarizer, corresponding to both the irises and the envelope, can be represented by means of simple geometrical shape uch as squares, rectangles, circles and ellipses.

SUMMARY OF THE INVENTION

The waveguide polarizer described herein avoids these problems allowing:

- an automated design procedure, thankes to accurate and efficient electromagnetic modeling of mechanical characteristics;
- simplified mechanical construction in a single piece;
- use of milling alone to make the irises, since machining the edges of the transverse sections is not required; and
- connection to other circular guides, of the type commonly used in antenna feeders, without the need of rectangular-to-circular waveguide transition pieces.

Particularly, this invention relates to a waveguide polarizer comprised of a waveguide section, with circular cross-section, inside which a certain number of elliptical irises are arranged at regular intervals, lying in parallel planes and all oriented in the same way, i.e. with their longer axes all belonging to the same axial plane.

BRIEF DESCRIPTION OF DRAWINGS

This characteristic, and others, of this invention will be illustrated with reference to a preferred embodiment, as non-limiting examples, in the enclosed drawings, wherein.

BEST MODE FOR CARRYING OUT THE INVENTION

Figure 1:
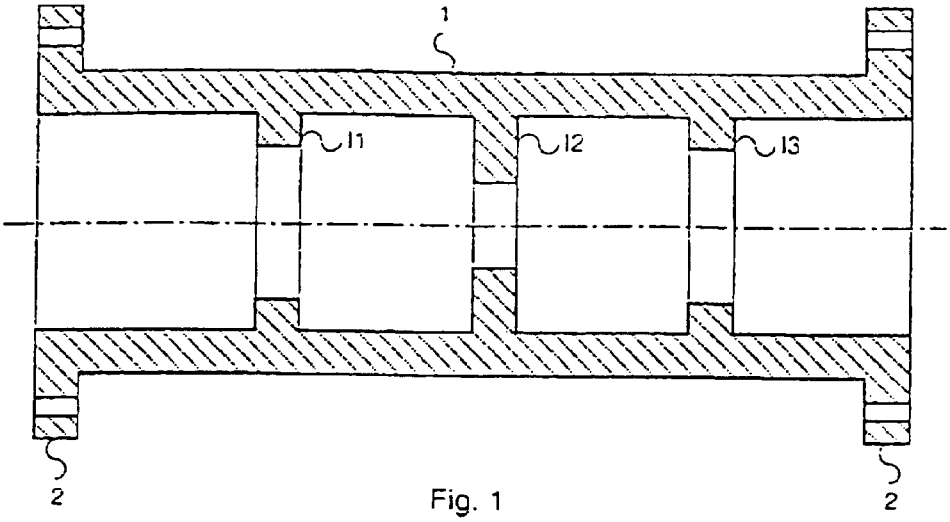
FIG. 1 is a longitudinal cross-section of the waveguide polarizer.
Figure 2:
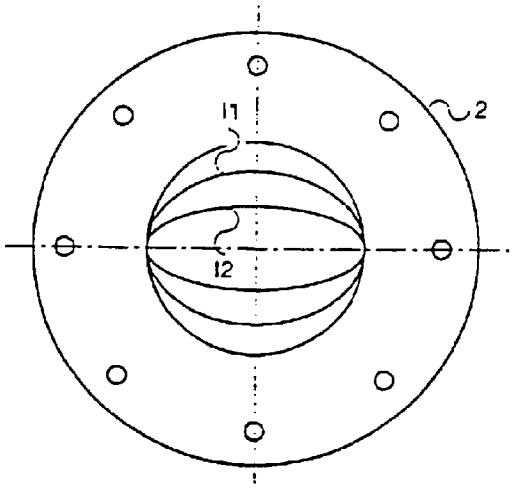
FIG. 2 is an end view.
Figure 3:
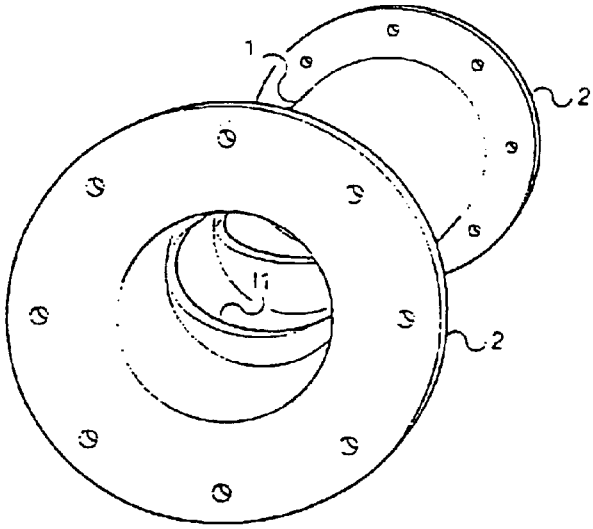
FIG. 3 is a perspective view.

As shown in the figures, the polarizer consists of a circular cross-section waveguide section 1 equipped with two terminal flanges 2 for connection to other circular guides, and a certain number of elliptical irises 11, 12 and 13. The irises are arranged at regular intervals, lying in parallel planes and all oriented in the same way, i.e. with their longer axes all belonging to the same axial plane. Furthermore, the longer axes are advantageously equal to the internal diameter of the guide, while the shorter axes are gradually tapered, from the ends to the half-way point of the polarizer, in a longitudinally symmetrical way.

Having established the number of irises according to the passband width and band ripple, one of the known automated design procedures will provide the constructive parameters of the polarizer when updated implementing the elliptical shape of the irises proposed in this invention. Particularly, the distance between the irises and their thickness (quantities which are normally constant), as well as the shorter axes of the ellipses, will be provided.

Naturally, numerous changes can be made to the construction and forms of embodiment of the invention herein envisaged, all comprised within the context of the claims hereof.

What is claimed is:

1. A waveguide polarizer comprising:

a waveguide section having circular cross-section; and a plurality of elliptical irises arranged inside said waveguide section at regular intervals, said irises lying in respective mutually parallel planes and being oriented with respective longer axes all in a common axial plane.

2. The waveguide polarizer according to claim 1 wherein the longer axes of said irises are each equal to an internal diameter of the waveguide.

3. The waveguide polarizer according to claim 2 wherein shorter axes of said irises are gradually tapered from respective ends to the half-way point of the polarizer in a longitudinally symmetric way.

4. The waveguide polarizer according to claim 2 wherein shorter axes of said irises are gradually tapered from respective ends to the half-way point of the polarizer in a longitudinally symmetric way.

5. The waveguide polarizer defined in claim 1 wherein said section is formed in one piece with said irises from metal, has flanges at opposite ends thereof, and the long axes of said irises are all equal to an internal diameter of said waveguide section.

* * * * *